United States Patent [19]

Stephenson et al.

[11] Patent Number: 4,934,589

[45] Date of Patent: Jun. 19, 1990

[54] COMPARTMENTAL PACKAGING SYSTEM WITH SEPARATE ACCESS

[75] Inventors: James G. Stephenson, Kalamazoo; Mark D. Huggett, Battle Creek, both of Mich.

[73] Assignee: Progressive Dynamics, Inc., Marshall, Mich.

[21] Appl. No.: 314,881

[22] Filed: Feb. 23, 1989

[51] Int. Cl.[5] ..... B65D 5/48

[52] U.S. Cl. ..... 229/120.28; 229/120.32; 229/122

[58] Field of Search ..... 229/122, 120.19, 120.28, 229/120.32

[56] References Cited

U.S. PATENT DOCUMENTS

| | | | |
|---|---|---|---|
| 1,558,305 | 10/1925 | Snape | 229/122 |
| 1,636,508 | 7/1927 | Goodyear | 229/120.28 |
| 1,974,527 | 9/1934 | Bliss | 229/23 |
| 3,182,792 | 5/1965 | Viltrakis | 206/57 |
| 3,193,152 | 7/1965 | White, Jr. | 222/182 |
| 3,262,631 | 7/1966 | Belsinger | 229/37 |
| 3,300,115 | 1/1967 | Schauer | 229/27 |
| 3,398,000 | 8/1968 | Peters | 229/122 |
| 3,568,911 | 3/1971 | Bebout | 229/17 |
| 3,701,466 | 10/1972 | Woodrow et al. | 229/17 B |
| 3,915,295 | 10/1975 | Morrison | 229/122 |
| 4,138,052 | 2/1979 | Torigan | 229/120.32 |
| 4,283,000 | 8/1981 | White | 229/17 B |
| 4,436,243 | 3/1984 | Nason et al. | 229/122 |

*Primary Examiner*—Gary Elkins

*Attorney, Agent, or Firm*—Beaman & Beaman

[57] ABSTRACT

A shipping container assembly formed of cut and scored fiber board having a rectangular shape including side walls, closeable end flaps forming the top and bottom of the container and a plurality of inner dividers dividing the interior of the container into at least two adjacent sub-compartments. At least one of the side walls is provided with an access door in alignment with one of the sub-compartments providing a separate access. One of the dividers includes a flat portion and a rectangular box portion being open on both ends defining a sub-compartment, whereby at least one of the open ends is in alignment with an access door.

4 Claims, 1 Drawing Sheet

COMPARTMENTAL PACKAGING SYSTEM WITH SEPARATE ACCESS

BACKGROUND OF THE INVENTION

This invention pertains to a shipping container or carton and more specifically to a shipping container divided on the interior into a plurality of sub-compartments whereby an auxiliary access door is provided in alignment with at least one of the sub-compartments providing a separate access thereto whereby the sub-compartment may be separately packed at different times.

Presently, there are a number of cartons and shipping containers available that are provided with a primary access whereby the containers may be readily and easily packed and unpacked and some of the containers utilize a separate access door to facilitate the dispensing of the contents thereof. Typical examples of these types of containers are shown in U.S. Pat. Nos. 3,262,631 and 4,283,000. There are also a number of containers presently available that are provided with access doors and are divided on the interior into a plurality of compartments by internal partitions, such as in U.S. Pat. No. 3,701,466.

Containers of the aforementioned type require that the entire carton contents be packed at the same time and it is not possible to quickly and easily vary the type of contents in a common carton. Also, the containers do not provide an access door in alignment with a sub-compartment wherein the sub-compartment is easily accessible via a separate access door.

It is an object of the invention to provide a container having a primary opening and an auxiliary access door therein in alignment with a sub-compartment to permit selective packing and wherein the container is inexpensive to manufacture, durable in structure and the sub-compartment is easily and readily packed and unpacked without use of the primary opening.

Another object of the invention is to provide a container having sub-compartments formed on the interior wherein a separate access door is provided in alignment with one of the sub-compartments for readily accessing thereof and whereby a portion of the carton may be pre-packed.

Another object of the invention is to provide a shipping container having an access door therein in alignment with a sub-compartment formed on the interior of the container, wherein the sub-compartment provides separation and added protection to its contents from other contents packaged within the container.

A further object of the invention is to provide a shipping container having an auxiliary access door in alignment with a sub-compartment, wherein the door is conveniently located such that it is accessible when the container is in a stacked relationship.

In the practice of the invention the container is formed of cut and scored fiber board folded into a rectangular shape having four side walls and closeable end flaps forming the top and bottom of the container. An access door is formed in one of the side walls in alignment with a sub-compartment formed on the interior of the container.

A separating panel is supported by an egg crate type divider and includes a flat portion and a rectangular box portion. The rectangular box portion is open at both ends and extends the full length of the container defining a sub-compartment. The panel is located such that one of the open ends of the sub-compartment is in alignment with an access door. The access door is hingedly connected and provides a separate access to the sub-compartment when the primary end flaps are closed.

The auxiliary access door provides for efficiency in shipping and handling such that contents may be easily placed or removed from the sub-compartment when the primary end flaps are closed permitting pre-packing of a portion of the carton and permitting selective packing of the sub-compartment. Also, the sub-compartment provides protection by separating the contents within the sub-compartment from other contents packaged in the container.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
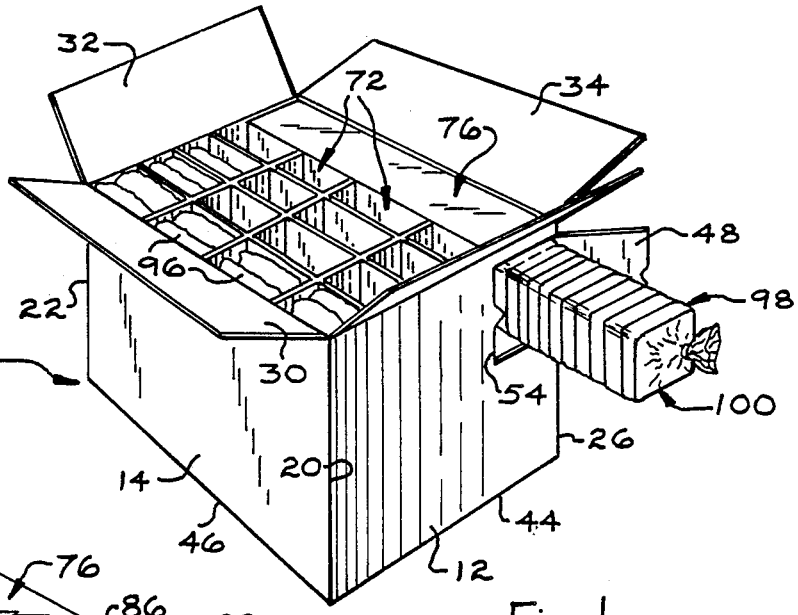
FIG. 1 is a perspective view of a shipping container provided with an auxiliary access door showing contents being packaged in the container in accord with the invention.
Figure 3:
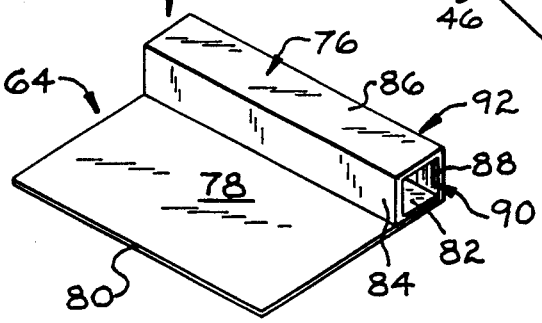
FIG. 3 is an enlarged, perspective view of the separating panel.
Figure 2:
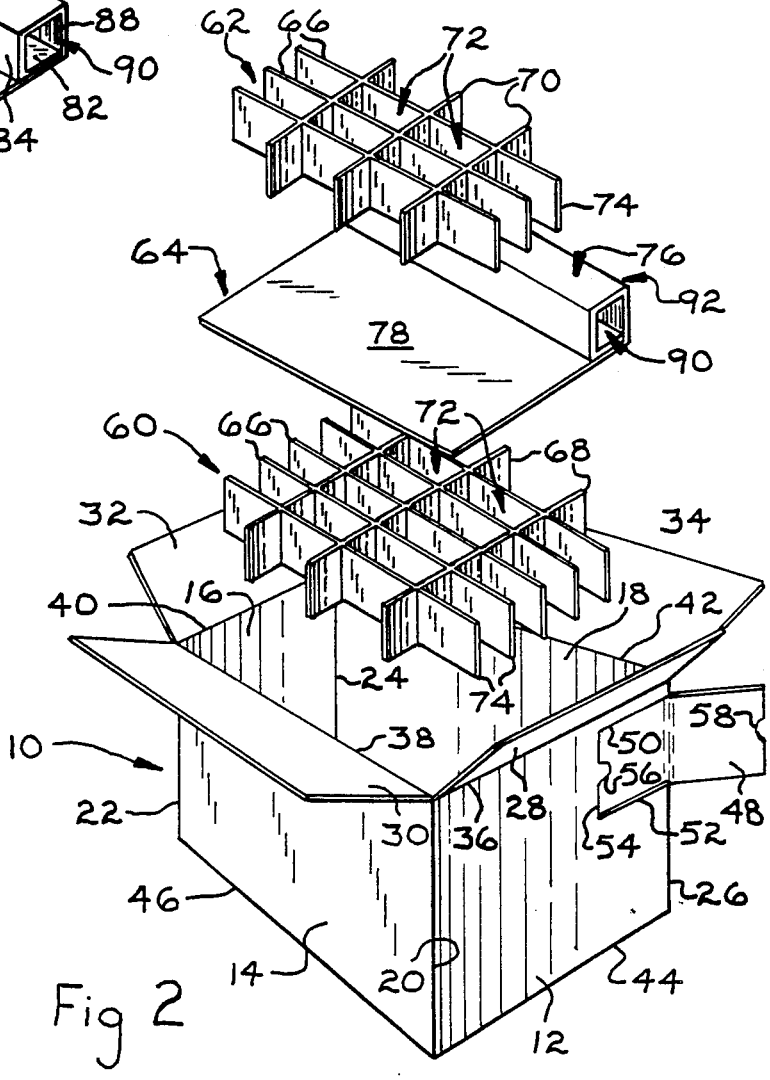
FIG. 2 is a perspective, exploded view of a shipping container showing the dividers and a separating panel having a sub-compartment formed thereon in accord with the invention.

Referring now to the drawings in detail, a shipping container or carton generally indicated at 10 is shown in FIGS. 1 and 2 utilizing inventive concepts in accord with the invention. The container 10 may be formed of a cut and scored fiber board blank, not shown, where it is foldable along score lines into a rectangular shape having side walls, closeable end flaps and an access door. The inside of the container is divided into a plurality of sub-compartments by inner dividers and a separating panel and an access door provides a separate access to one of the sub-compartments.

As shown in FIGS. 1 and 2, the container 10 includes rectangular side walls 12, 14, 16, and 18, the walls being connected to each other along edges 20, 22, 24 and 26. Each of the side walls 12, 14, 16 and 18 are provided with integrally extending top flaps 28, 30, 32 and 34, respectively, connected along foldable score lines 36, 38, 40 and 42. The container 10 is closed at its top by folding the opposed flaps 28 and 32 inwardly and then folding flaps 30 and 34 inwardly thereover and the container top flaps define the container primary opening. The side walls are also provided with bottom flaps, not shown, wherein edges 44 and 46 are formed from the bottom flaps adjacently joined to side walls 12 and 14, and when folded over in the same manner close the bottom of the container 10. The flaps are generally held closed by tape sealing the container in a closed condition as is known.

A separate access door 48 is formed in the side wall 12. The door 48 is defined by a pair of parallel, vertical or longitudinal cuts 50 and 52. The cut 50 is spaced inwardly from and parallel to the edge 36 and the cut 52 is spaced inwardly from and parallel to the bottom edge 44. The cuts 50 and 52 terminate at one end in the central portion of the side wall 12 on a transverse cut 54 and terminate at the other end on the folded edge 26 where the door 48 is hingedly connected. The cut 54 includes a curved portion defining a tongue 56 which forms a notch 58 in the door 48 in which a finger can be inserted to facilitate opening of the door.

In FIG. 2, a pair of dividers 60 and 62 and a panel 64 are shown prior to being inserted into the container 10. Both the dividers 60 and 62 have an egg crate configuration formed by a plurality of narrow elongated pieces intersecting a plurality of shorter elongated pieces. The divider 60 having pieces 66 intersecting pieces 68 and the divider 62 having pieces 66 intersecting pieces 70. The only difference between the dividers is that the length of pieces 70 of the divider 62 are shorter than the length of pieces 68 of the divider 60. Both dividers have rectangular spaces or cells 72 created by the intersecting pieces and have an overall height equal to the height of the ends 74 of the pieces 66. In a commercial embodiment the cells 72 are of such a dimension as to receive the bases of light fixtures used with recreational vehicles such as trailers and motor homes.

The panel 64 is formed from a rectangular sheet of fiber board having four parallel scored lines spaced inwardly from a given edge and extending the full length of the sheet. By folding the sheet along the score lines a rectangular box 76 is formed adjacent the flat portion 78 having a length defined by the length of the flat portion edge 80. The box 76 has sides 82, 84, 86 and 88 defining a sub-compartment 90. The sub-compartment 90 is open at both ends 92 and 94 and has a length equal to the length of the flat portion as defined by the edge 80.

The dividers 60 and 62 and the panel 64 are placed in the container 10 such that the lower divider 60 lies flat on the bottom of the container, the panel 64 is supported by the divider 60 with end 92 of the sub-compartment 90 in alignment with the door 48 and the divider 62 rests on the flat portion 78 of the panel 64.

The width of the sub-compartment 90 as defined by sides 84 and 88 is equal to the width of the door 48 as defined by the edge 26 and cut 54 and the height of the sub-compartment 90 as defined by the sides 82 and 86 is greater than the height of the door opening as defined by the cuts 50 and 52. The height of the lower divider 60 is less than the height of the cut 52 from the bottom edge 44 so that when the panel 64 is supported on the divider 60 the lower side 82 of the sub-compartment 90 is lower than the cut 52, and the top side 86 of the sub-compartment 90 is the same height as cut 50 is from the bottom edge 44, thereby forming an abutment to the sub-compartment 90 preventing contents from prematurely sliding out of the sub-compartment.

The overall length and width of the divider 60 as defined by the length of pieces 66 and 68, respectively, are slightly less than the length and width of the inside of the container 10 such that the divider 60 may placed on the bottom of the container without force yet is prevented from movement. The divider 62 rests on the flat portion 78 of the panel 64 and is prevented from moving by the box portion 76 and the container 10. The height of pieces 66 and 70 of divider 62 is equal to that of the side 84 of box 76.

As shown in FIG. 1, bases and lenses for recreational vehicle lights are packaged in the container 10 utilizing inventive concepts in accord with the invention. Light bases 96 are packaged in the cells 72 created by the egg crate dividers 60 and 62 and the lenses 98 are packaged in a bag 100 inserted in the sub-compartment 90 through access door 48. This type of packaging allows the bases 96 to be pre-packed in the container 10 prior to the lenses being inserted into the sub-compartment 90. As the bases are of a standard design, but the lenses 98 are of several ornamental designs, orders may easily be filled by quickly placing the desired design of lenses in the pre-packed containers of bases 96 permitting "custom" shipping from packed and inventoried bases. The door 48 may be taped in the closed position after the bag 100 is inserted into sub-compartment 90.

It is appreciated that various modifications to the inventive concepts may be apparent to those skilled in the art without departing from the spirit and scope of the invention.

We claim:

1. In combination, a compartmental shipping container assembly having an interior, a to and a bottom and formed of cut and scored fiber board including side walls having edges defined by foldable score lines, closeable end flaps forming the top and bottom of the container defining a primary opening, a panel within said container, an elongated sub-compartment fixed upon said panel having an open end and a transverse cross-sectional configuration, an access opening defined in one of said side walls of a configuration substantially corresponding to said sub-compartment transverse cross sectional configuration in alignment with said sub-compartment open end between the top and bottom of said one side wall a door movably mounted on said one side wall corresponding in configuration to said access opening and adapted to close said access opening, said door and said opening providing access to said sub-compartment when said end flaps are closed.

2. In a compartmental shipping container assembly as in claim 1, said sub-compartment having a rectangular cross-sectional shape including opposing side walls and opposing top and bottom walls, said sub-compartment open end having a width defined by its opposing side walls and a height defined by its top and bottom walls, said sub-compartment width being equal to the width of said access opening and said door and said sub-compartment height being greater than the height of said access opening and said door.

3. In a compartmental shipping container as in claim 2 wherein said sub-compartment bottom wall is closer to the bottom of said container than the lower most portion of said access opening and said door.

4. In a compartmental shipping container assembly as in claim 2, said sub-compartment side, top and bottom walls being homogeneously defined of the material of said panel.

* * * * *